United States Patent [19]

Andres

[11] Patent Number: 4,706,807

[45] Date of Patent: Nov. 17, 1987

[54] SHOE POLISHING KIT

[76] Inventor: Kathleen Andres, P.O. Box 1857, Decatur, Ga. 30031

[21] Appl. No.: 858,192

[22] Filed: May 1, 1986

[51] Int. Cl.[4] ..... B44D 3/40; B65D 23/12

[52] U.S. Cl. ..... 206/229; 15/114; 222/386; 401/176

[58] Field of Search ..... 15/114, 258; 206/229; 222/386; 401/141, 142, 145, 146, 171, 176

[56] References Cited

U.S. PATENT DOCUMENTS

| | | | |
|---|---|---|---|
| 1,368,078 | 2/1921 | Vanderbilt, Jr. | 15/114 |
| 2,009,761 | 7/1935 | Calderara | 222/386 |
| 2,978,722 | 4/1961 | Kusakabe | 401/176 |
| 3,000,035 | 9/1961 | Harris et al. | 206/229 |

FOREIGN PATENT DOCUMENTS

| | | | |
|---|---|---|---|
| 2132249 | 1/1973 | Fed. Rep. of Germany | 401/171 |
| 1021941 | 12/1952 | France | 401/176 |
| 1124161 | 6/1956 | France | 206/229 |

*Primary Examiner*—Jimmy G. Foster
*Attorney, Agent, or Firm*—Handal & Morofsky

[57] ABSTRACT

A shoe polishing kit comprises polish storage structure including first sidewalls defining inside walls and including a base closing member disposed at one end of the first sidewalls. Polish is disposed in the polish storage structure. An orifice is defined proximate to said polish. Support structure is secured about the orifice and is adapted to support a member in the orifice. A matrix is configured and dimensioned to be supported by the support structure within the orifice with a portion of the matrix extending from the orifice. A cap structure is associated with the support structure and is secured thereto, covering the matrix. The plunger structure is positioned adjacent the other end of the first sidewalls. A shoe polishing rag containing compartment is secured to the cap structure. The orifice is defined in the first sidewalls, and the compartment is disposed on a side of the closing member which is opposite the plunger structure.

12 Claims, 4 Drawing Figures

SHOE POLISHING KIT

TECHNICAL FIELD

The present invention relates to a self-contained shoe polishing kit incorporating a specialized and versatile container.

BACKGROUND

At the present time there are a great number of products for polishing shoes and other leather goods. Such products include of relatively hard paste polishes, bottles of liquid polish and tubes of cream polish. Because polishing operations generally require the use of an applicator and a buffing device, to varying extents these polishes may be packaged with the same. For example, tubes of cream polish are often packaged with a piece of cloth for application, paste type polishes may be packaged with a sponge applicator and liquid polishes may include an applicator ball at the end of a rod attached to the cap of a bottle.

Such available polishing kits suffer from a number of disadvantages. For example, the elements are used individually and not always maintained in association with each other in a single complete package during storage, polishing, and buffing operations. Accordingly, applicators may become associated with the wrong polish color. Finally, it is possible, for existing polishing kits, to easily forget to put all of the components away together.

SUMMARY OF THE INVENTION

The present invention, as claimed, is intended to provide a remedy. It solves the problem of providing a polishing kit in which all necessary elements are contained in a single package for storage. For the application of polish, only the cap is separated from the rest of the kit. An indicating structure is provided to show whether the polishing cloth has been reassociated with the cap and polish container prior to closing the cap, thus insuring that the entire kit is put together completely before storage.

The same is achieved in accordance with the preferred embodiment by providing a polish containing can having an applicator and polish advancing structure and a mating cap which includes a compartment for a buffing cloth.

BRIEF DESCRIPTION OF DRAWINGS

The invention is illustrated in conjunction with the drawings, which illustrate only one embodiment of the invention, in which.

BEST MODE FOR CARRYING OUT THE INVENTION

Figure 1:
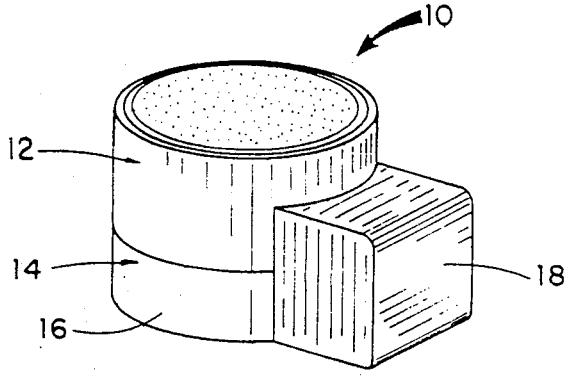
FIG. 1 is in perspective view of the polishing kit constructed in accordance with the present invention.

Referring to FIG. 1, a kit 10 in constructed in accordance with the present invention is illustrated. Generally the kit includes a body assembly 12 and a cap assembly 14. Cap 14 includes a storage portion 16 and an applicator protector 18 which are both formed integrally with one another.

Figure 2:
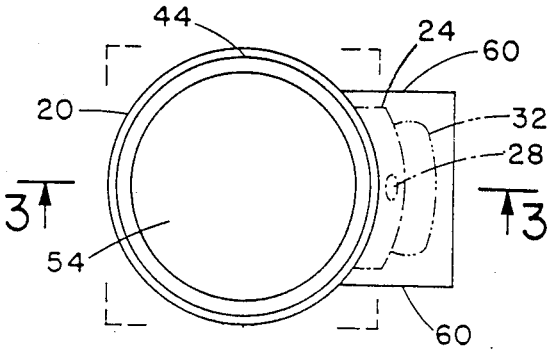
FIG. 2 is a top plan view of the kit illustrated in FIG. 1.
Figure 3:
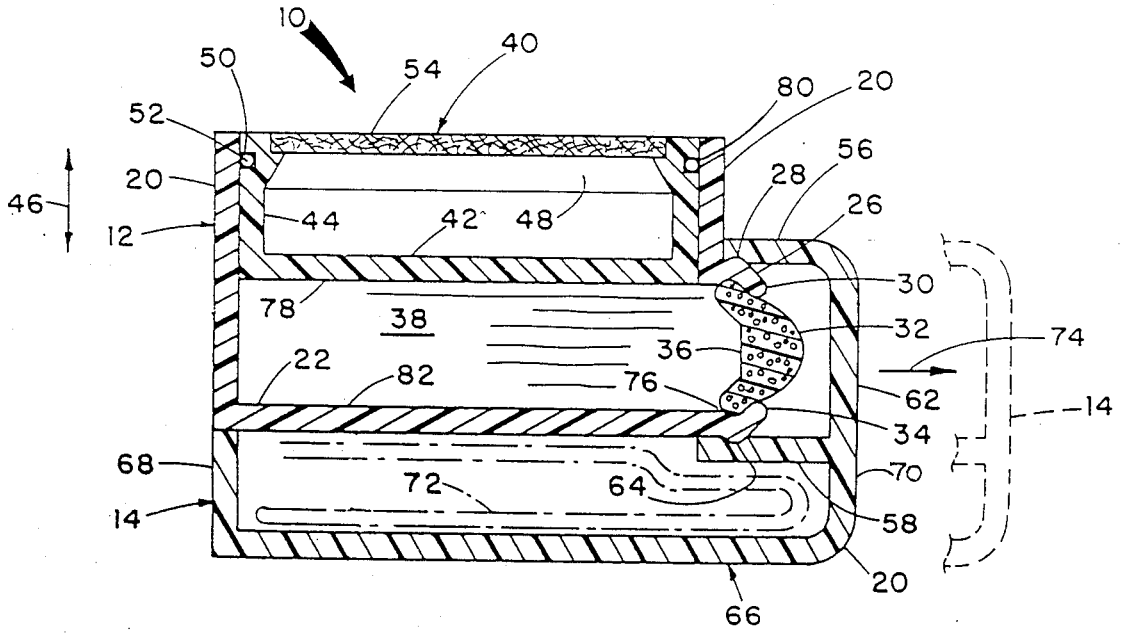
FIG. 3 is a view along lines 3—3 of FIG. 2.

As shown in FIGS. 2 and 3, body 12 generally comprises a cylindrical side wall 20 and a container bottom 22 formed integrally therewith and made of plastic or any other suitable material. An applicator support 24 is also formed integrally with body 12. The outside surface 26 of support 24 includes a raised detent engaging extension 28. A mouth 30 is defined by and receives a polish feeding matrix 32. Matrix 32 is glued to the upper and lower inside surfaces 34 of support 24. Matrix 32 is provided with an area increasing surface 36 which is adopted to present a relatively large area for the feeding of polish 38 contained within body assembly 12. Matrix 32 may be made of foam rubber or any other suitable permeable and compressable material.

The polish 38 contained within body 12 is retained therein by a plunger 40. Plunger 40 comprises a bottom 42 and sidewalls 44 formed integrally therewith. Plunger 40 is mounted for sliding movement in the directions of arrow 46. Sidewalls 44 are provided with and angular support extension 48. An annular O-ring 52 is set in a receiving groove 50 serves defined by the outside of sidewall 44. O-ring 52 the purpose of providing a sealing engagement between plunger 40 and sidewalls 20. Plunger 40 may be made of plastic or any other suitable material while O-ring 52 may be made of rubber or a similar synthetic material. If desired, plunger 40 may also include a cover 54 which may be made of cardboard or another less expensive material and may bear advertising material or the like.

The outside surface of the matrix 32 is protected from inadvertent contact with other objects by cap assembly 14. Cap assembly 14 includes a pair of upper and lower cap sidewalls 56 and 58 respectively and a pair of side sidewalls 60 and a cap front 62. Upper and lower cap sidewalls 56 and 58 include extension receiving detents 64 which mate with the extensions 28 and provide snapping engagement between the body assembly 12 and the cap assembly 14 due to the resilience of upper and lower cap sidewalls 56 and 58. A buffing cloth receiving compartment 66 is also formed integrally with the cap formed by walls 56-62. Compartment 66 includes sidewalls 68 and 70. A buffing cloth 72 may most conveniently be stored within compartment 66 as illustrated in FIG. 3.

It is noted that area increasing surface 36 and clearance 76 define a chamber into which polish may accumulate during the downward movement of plunger 40. It is also noted that in order for all of polish 38 to be properly fed, the distance between the bottom 78 of plunger 40 and the sealing point 80 just below O-ring 52 must be at least as large as the distance between bottom surface 78 and the inside bottom surface 82 of the body compartment.

When one wishes to use the inventive kit, one simply removes cap assembly 14 by moving it in the direction of arrow 74 with respect to body assembly 12 as shown in phantom lines in FIG. 3. One then depresses cover 54, advancing the polish, which has a cream-like consistency into matrix 32 for application. It is contemplated that the repeated application of pressure to the outside of matrix 32 during use will have the effect of dispersing the cream polish throughout the matrix. Additional polish can be fed by the application of pressure to cover 54.

Once the application of polish has been completed, buffing cloth 72 is removed from cap assembly 14 and the shoes are buffed in the conventional matter. After this, the cloth may be replaced into compartment 66 and the cap may be replaced on the body assembly 12. In the event that one forgets to put the buffing cloth in the compartment, the natural habit which the user will develop of arranging the cloth properly in the compartment to avoid jamming before putting the cap assembly onto the body assembly will serve as a warning that the buffing cloth has not been put in its proper place.

Figure 4:
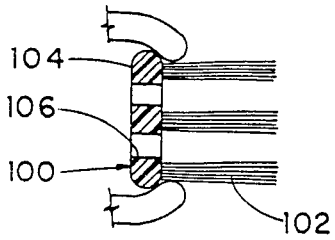
FIG. 4 is a view of an alternative polish applicator useful in the invention.

While an illustrative embodiment of the invention has been described, it is, of course, understood that various modifications will be obvious to those of ordinary skill in the art. For example, matrix 32 may be replaced by a brush 100 with bristles 102, in which the base 104 in which bristles 102 are mounted has a number of holes 106 disposed therein for feeding polish from the inside of body assembly 12 into the bristles as shown in FIG. 4. Such modifications are within the spirit and scope of the invention which is limited and defined only by the appended claims.

I claim:

1. A shoe polishing kit, comprising:

(a) polish storage means, comprising:

(i) first sidewalls defining inside walls; and (ii) a base closing member disposed at one end of said first sidewalls;

(b) plunger means for advancing polish disposed within said sidewalls;

(c) polish disposed in said polish storage means;

(d) an orifice defined proximate to said polish;

(e) support means secured about said orifice and adapted to support a member within said orifice;

(f) a matrix configured and dimensioned to be supported by said support means within said orifice with a portion of said matrix extending from said orifice; and (g) cap means associated with said support means for being secured to said support means and covering said matrix, wherein said plunger means is positioned adjacent the other end of said first sidewalls and further comprising a shoe polishing rag containing compartment secured to said cap means, and wherein said orifice is defined in said first sidewalls and said compartment is disposed on a side of said closing member which is opposite said plunger means.

2. A shoe polishing kit, as in claim 1, wherein detent and extension means are associated with said cap means and said support means in order to provide for snappingly locking engagement between said cap means and said support means.

3. A shoe polishing kit, as in claim 2, wherein a substantial portion of said first and second sidewalls are defined by a line moving parallel to itself along the perimeter of a two dimensional object.

4. A shoe polishing kit, as in claim 3, wherein said two dimensional object is a circle.

5. A shoe polishing kit, as in claim 1, wherein said polish is a quantity of cream type polish having a consistency softer than a paste while still maintaining a tendency to substantially retain its shape is disposed between the closing member of said polish storage means and said plunger means.

6. A shoe polishing kit, as in claim 3, wherein a buffing cloth is disposed within said compartment.

7. A shoe polishing kit, as in claim 1, wherein an annular sealing member is disposed between said plunger means and said first sidewalls in order to insure sealing engagement there between, said annular member being mounted for movement with said plunger means.

8. A shoe polishing kit, as in claim 7, wherein said plunger means has a bottom closing surface and said annular sealing member is disposed at the top of said plunger and the distance between the seal point of said annular member and the bottom outside surface of said plunger means closing surface is at least as large as the distance between the bottom of said plunger means closing member and the inside surface of the closing member of said polish storage means.

9. A shoe polishing kit, as in claim 1, wherein said matrix has an application end extending out from said polish storage means and defines an area increasing surface disposed adjacent said polish and opposite the application end of said matrix, said applicator extending from said support means.

10. A shoe polishing kit as in claim 1, wherein said matrix is a bristle brush with holes in its bristle supporting base.

11. A shoe polishing kit as in claim 1, wherein said matrix is a polymeric material incorporating air spaces.

12. A shoe polishing kit as in claim 1, wherein said compartment substantially underlies said polish storage means and forms a continuous surface therewith.

* * * * *